United States Patent [19]

Fujishiro

[11] Patent Number: 4,725,050

[45] Date of Patent: Feb. 16, 1988

[54] MULTI-SECTION FOLDING APPARATUS FOR ROTARY PRESS

[75] Inventor: Yuji Fujishiro, Tokyo, Japan

[73] Assignee: Tokyo Kikai Seisakusho, Tokyo, Japan

[21] Appl. No.: 887,327

[22] Filed: Jul. 22, 1986

[51] Int. Cl.[4] ..... B41F 13/58

[52] U.S. Cl. ..... 270/5; 226/199; 270/21.1

[58] Field of Search ..... 270/5, 52, 21.1, 41, 270/43; 226/197, 199; 101/224, 226, 227; 493/346

[56] References Cited

U.S. PATENT DOCUMENTS

| | | | |
|---|---|---|---|
| 2,050,031 | 8/1936 | Wood | 270/5 |
| 2,361,140 | 10/1944 | Wolf | 270/5 |
| 2,613,077 | 10/1952 | Smith, Jr. | 270/5 |
| 2,920,887 | 1/1960 | Keightley | 270/5 |
| 3,623,645 | 11/1971 | Klingler | 226/197 |
| 3,809,303 | 5/1974 | Brunner | 226/197 |
| 4,154,386 | 5/1979 | Kawada | 226/197 |
| 4,532,864 | 8/1985 | Heller et al. | 226/197 |
| 4,538,517 | 9/1985 | Michalik et al. | 270/21.1 |
| 4,587,898 | 5/1986 | Welschlau | 101/224 |
| 4,605,210 | 8/1986 | Hechler | 270/41 |

FOREIGN PATENT DOCUMENTS

| | | | |
|---|---|---|---|
| 340607 | 1/1931 | United Kingdom | 270/5 |
| 363450 | 12/1931 | United Kingdom | 270/5 |
| 399538 | 4/1933 | United Kingdom | 270/5 |

*Primary Examiner*—E. H. Eickholt

*Attorney, Agent, or Firm*—Trexler, Bushnell, Giangiorgi & Blackstone, Ltd.

[57] ABSTRACT

A multi-section folding apparatus has two outer formers which are respectively provided on both sides of a pair of inner formers which are defined by a pair of upper and/or lower formers of a vertical two-stage former folding machine in such a manner that the outer formers are positioned at the same level as that of the inner formers and with a slight spacing provided therebetween, thereby forming a quadruple former assembly. Two groups of turn bar mechanisms are disposed in such a manner that the course of each of the halved traveling sheets which are obtained by halving a traveling sheet and which are fed toward the two inner formers along their respective ones of the four travel lanes is changed to any one of the other three travel lanes. It is therefore possible to issue a newspaper made up of six to eight sections by means of straight folding without lowering the production speed. In addition, it is possible, by virtue of the turn bar mechanisms, to issue a newspaper made up of an odd-number section in addition to an even-number section, and also to set as desired the number of pages of each of the sections constituting a newspaper.

8 Claims, 23 Drawing Figures

MULTI-SECTION FOLDING APPARATUS FOR ROTARY PRESS

BACKGROUND OF THE INVENTION

1. Field of the Invention

The present invention relates to a multi-section folding apparatus for use in a rotary press, particularly a web press for printing newspapers, which is so designed that it is possible to increase the number of sections (volumes) of a newspaper issued at a time.

2. Description of the Related Art

Newspapers of ordinary size are generally issued in the form that two to eight sheets each having four pages are overlaid one upon another and folded in two to form a volume which is known as a section. In Japan, newspapers are sometimes issued in parts. More specifically, feature articles or the like are printed in an additional independent section of several pages which is separate from the above-described section, and the pages of the whole of the newspaper are numbered consecutively. Most of these newspapers are issued in two sections, and, for example, newspapers issued on New Year's Day may have three sections. It is more popular in America than Japan to issue newspapers in two or more sections.

These days, however, it is necessary to handle information over a considerably wide range of fields and in tremendous amounts. For this reason, the number of pages of newspapers is increasing more and more. There are some newspapers which are considered that it is preferable to issue them in sections from the viewpoint of transfer of information. It is also preferable from the reader's side that feature articles and the like are issued in another section, because it is easy to keep feature articles in such form as materials. In addition, a newspaper issued in a plurality of sections has the merit that a plurality of persons can read them at the same time. In the course of distribution also, a newspaper of one section with a multiplicity of pages, when folded twice for transportation, become bulky and cannot be handled easily, which means that there is fear of the newspaper being damaged. Therefore, it may be advantageous to make up a newspaper of a plurality of sections.

It may be possible to effect a multi-section folding operation using a conventional vertical two-stage folding machine consisting of two pairs of lower and upper formers A, B and C, D, such as that shown in FIG. 15. However, this type of conventional folding machine has a limited capacity, so that it cannot satisfactorily serve for a system for issuing a multi-section type newspaper. The reasons for this are as follows.

(a) The above-described conventional folding machine can effect 1- to 4-section folding operations and deliver these sections by means of straight folding (capable of producing two copies per full turn of the printing cylinder).

(b) However, the conventional folding machine cannot fold odd-number sections, that is, five and seven sections, among the multiple sections more than four because of a mechanism characteristic of it.

(c) It is possible to fold even-number sections, that is, six and eight sections, by conducting collecting (also known as gathering, that is, folidng one copy per full turn of the printing cylinder) at a folding cylinder. However, in such case the production capacity is reduced to ½ of the above-described straight folding.

(d) In the case of, for example, an eight-section folding operation, the above-described collect folding does not permit the number of pages of each of the sections constituting a newspaper to be set as desired. More specifically, the number of pages is restricted to the same between each pair of corresponding sections, that is: 1 and 5; 2 and 6; 3 and 7; and 4 and 8. It is impossible to make them differ from each other due to the mechanism of the apparatus.

SUMMARY OF THE INVENTION

In view of the above-described circumstances, it is a first object of the present invention to provide a multi-section folding apparatus which is capable of speedily and reliably coping with changes in the form of issuing newspapers, from one-section multiple-page type newspapers to multiple-section type newspapers, which are expected to take place in the near future as the need for information increases over a wider range of fields and the amount of information to be provided increases.

It is a second object of the present invention to provide a multi-section folding apparatus which is so designed that it is possible to speedily, reliably and inexpensively cope with the above-described changes simply by extending and fully utilizing a conventional former folding machine which has already been installed It is a third object of the present invention to provide a multi-section folding apparatus which is so designed that any desired multi-section folding operation can be effected by means of straight folding, and it is possible to effect a high-speed multi-section folding operation without impairing the production capacity.

It is a fourth object of the present invention to provide a multi-section folding apparatus which is capable of realizing any multi-section folding operation whether the number of sections is odd or even.

It is a fifth object of the present invention to provide a multi-section folding apparatus which enables the number of pages of each of the sections constituting a newspaper to be set as desired.

To these ends, the present invention provides a multi-section folding apparatus wherein two outer formers are respectively provided on both sides of a pair of inner formers which are defined by a pair of upper and/or lower formers of a vertical two-stage former folding machine in such a manner that the outer formers are positioned at the same level as that of the inner formers and with a slight spacing provided therebetween, thereby forming a quadruple former assembly, and two groups of turn bar mechanisms are disposed in such a manner that the course of each of the halved traveling sheets which are obtained by halving a traveling sheet and which are fed toward the two inner formers along their respective ones of the four travel lanes is changed to any one of the other three travel lanes.

The present invention can, of course, be carried out using new parts, but it is also possible, by virtue of the above-described arrangement, to fully utilize a conventional vertical two-stage former folding machine which has already been installed. In such case, formers are additionally provided on both sides of and adjacent to a pair of upper and/or lower formers, respectively, of the folding machine, thereby forming a folding apparatus consisting of six to eight formers in any one of the following combinations: four upper formers and two lower formers; two upper formers and four lower formers; and four upper formers and four lower formers. It is therefore possible to issue a newspaper made up of six to eight sections by means of straight folding without lowering the production speed.

In addition, turn bar mechanism are disposed in such a manner that the course of each of the halved traveling sheets which are to be introduced to two inner formers, respectively, among the four formers adjacent to each other along their respective ones of the four lanes can be changed to any one of the other three lanes. It is therefore possible to issue a newspaper made up of odd-number sections in addition to even-number sections, and also to set as desired the number of pages of each of the sections constituting a newspaper. Thus, it becomes possible to edit a newspaper as desired with substantially no restriction on the number of sections and the number of pages.

The above and other objects, features and advantages of the present invention will become clear from the following description of the preferred embodiments thereof, taken in conjunction with the accompanying drawings.

BRIEF DESCRIPTION OF THE DRAWINGS

FIGS. 4(A), 4(B) to 11(A), 11(B) show various practical examples of changing the course of a traveling sheet of paper, in which: Figures with the suffix (A) are sectional plan views similar to FIG. 2, which show only an essential part of the embodiment; and Figures with the suffix (B) are sectional side views similar to FIG. 3, which show only an essential part of the embodiment, and of which:

FIG. 4 shows an example in which both the right- and left-hand halved sheets travel straight forward, and the their courses are not changed;

FIG. 5 shows an example in which the course of the halved sheet traveling on the lane a is changed to the lane g, and the course of the halved sheet traveling on the lane b is changed to the lane g;

FIG. 6 shows an example in which the halved sheet on the lane a is allowed to travel straight forward, while the course of the halved sheet taveling on the lane b is changed to the lane h;

FIG. 7 shows an example in which the halved sheet on the lane b is allowed to travel straight forward, while the course of the halved sheet traveling on the lane a is changed to the lane g;

FIG. 8 shows an example in which the halved sheet on the lane a is allowed to travel straight forward, while the course of the halved sheet traveling on the lane b is changed to the lane a;

FIG. 9 shows an example in which the halved sheet on the lane b is allowed to travel straight forward, while the course of the halved sheet traveling on the lane a is changed to the lane b;

FIG. 10 shows an example in which the halved sheet on the lane b is allowed to travel straight forward, while the course of the halved sheet traveling on the lane a is changed to the lane h;

FIG. 11 shows an example in which the halved sheet on the lane a is allowed to travel straight forward, while the course of the halved sheet taveling on the lane b is changed to the lane g;

DESCRIPTION OF THE PREFERRED EMBODIMENTS

The present invention will be described hereinunder in details by way of embodiments and with reference to the accompanying drawings.

Figure 12:
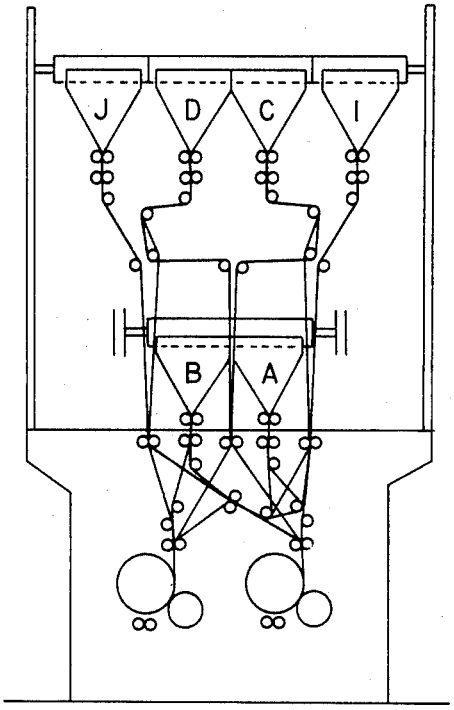
FIG. 12 is a front view of a second embodiment of the present invention.
Figure 13:
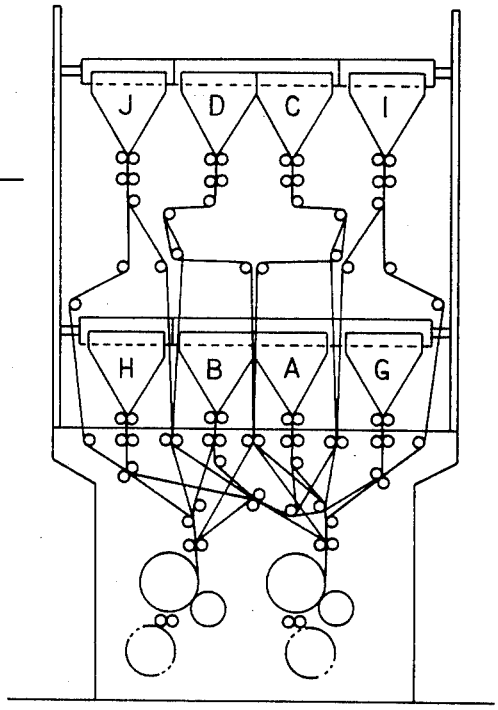
FIG. 13 is a front view of a third embodiment of the present invention.
Figure 14:
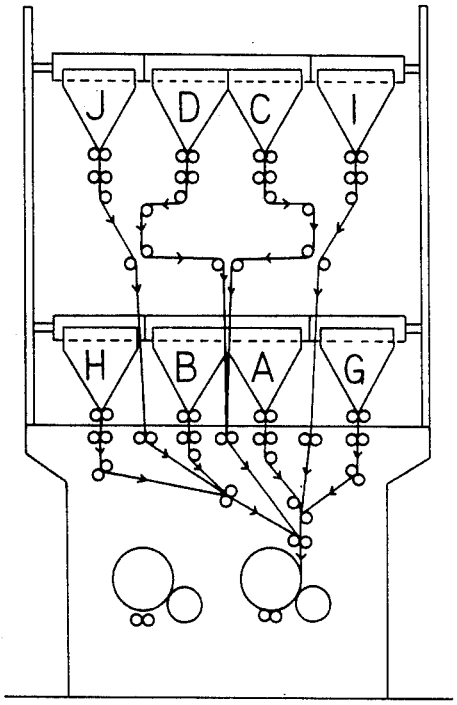
FIG. 14 is a view employed to explain an eight-section straight folding operation in accordance with the third embodiment.

A first embodiment (shown in FIGS. 1 to 11) exemplifies a multi-section folding apparatus capable of folding six sections at maximum arranged by additionally providing formers G and H on both sides, respectively, of the pair of lower fomers A and B in a conventional vertical two-stage former folding machine which has already been installed and which consists of two pairs of lower and upper formers A, B and C, D. A second embodiment (shown in FIG. 12) exemplifies a multi-section folding apparatus capable of folding six sections at maximum arranged by additionally providing formers I and J on both sides, respectively, of the pair of upper formers C and D in the above-described conventional former folding machine. In addition, a third embodiment (shown in FIGS. 13 and 14) exemplifies a multi-section folding apparatus capable of folding eight sections at maximum arranged by additionally providing formers G and H on both sides, respectively, of the pair of lower formers A and B and further providing formers I and J on both sides, respectively, of the pair of upper formers C and D of the above-described conventional folding machine.

The pair of outer formers G, H or I, J are respectively disposed on both sides of the pair of inner formers A, B or C, D in such a manner that they are positioned at the same level as that of the inner formers, so as to form in combination a quadruple former assembly. It is, however, necessary to provide a slight spacing l between the opposing inner and outer formers. This is because, if sheet travel lanes g, h which respectively extend toward the outer formers are disposed too close to sheet travel lanes a, b which respectively extend toward the inner formers, traveling sheets may interfere with each other to cause a trouble. In addition, in order to prevent bending of a drag roll 20, guide rolls 21 and an adjusting roll 22 which are elongated in proportion to the full width of the quadruple former assembly, it is preferable from the veiwpoint of strength that they are also supported by two side frames 25 and 26 which have already been installed, in addition to two side frames 23 and 24 which are additionally provided for supporting the above-described rolls. For example, when a longest roll is used, the effective length of each of the drag roll 20, the guide rolls 21 and the adjusting roll 22 needs to be equal, at least, to a value obtained by adding together double the maximum width of a full-width traveling sheet W and double the spacing l. The drag roll 20 having a relatively large width may be divided into three portions, that is, a central portion for a full-width sheet and two right and left portions for halved sheets, as illustrated.

A web consisting of plurality of full-width traveling sheets W which have already been printed and delivered from a plurality of printers, respectively, is passed over a first drag roll DR having a slitter knife SK on the center thereof, whereby each sheet W is divided longitudinally into two halved sheets W/2. If they are allowed to travel straight forward thereafter, they travel along the travel lanes a and b which respectively extend toward the pair of inner formers A and B in the quadruple former assembly.

Figure 4A:
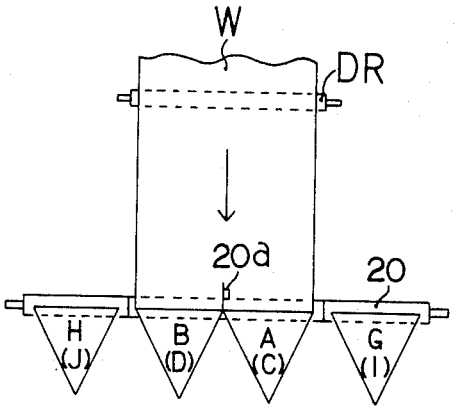
Figure 4B:
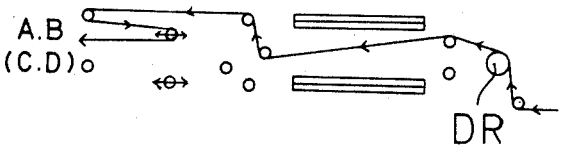

When the traveling sheet is allowed to travel straight forward as shown in FIGS. 4(A) and 4(B), the full-width sheet is preferably halved on the drag roll 20 directly above the quadruple former assembly rather than on the first drag roll DR in order to prevent any interference of the sheet. When the full-width traveling sheets W are cut on the drag roll 20, they are halved by a slitter knife 20*a* provided on the drag roll 20, whereas, when the sheets W are cut on the drag roll DR, they are halved by the slitter knife SK provided thereon.

It should be noted that, as is well known, a drag roll 27 exclusively used for the pair of upper formers C and D is provided directly above them.

Travel lanes for halved sheets W/2 which extend from the first drag roll DR to the drag roll 20 above the quadruple former assembly total to four, including two inner lanes a, b and two newly provided outer lanes g, h. According to the present invention, turn bars are respectively disposed above the travel lanes to enable the course of a part or the whole of the halved sheets W/2 traveling on one lane a to be changed to any of the other lanes b, g and h and also enable the course of a part or the whole of the halved sheets W/2 traveling on the other lane b to be changed to any of the other three lanes a, g and h, thereby allowing an increase in the number of sections, and further permitting the number of pages of each of the sections constituting a newspaper to be changed as desired.

Figure 1:
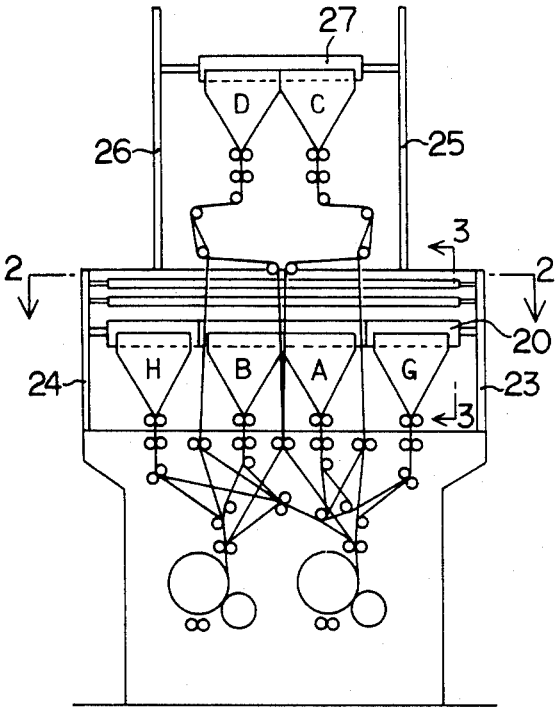
FIG. 1 is a front view of a first embodiment of the present invention.
Figure 2:
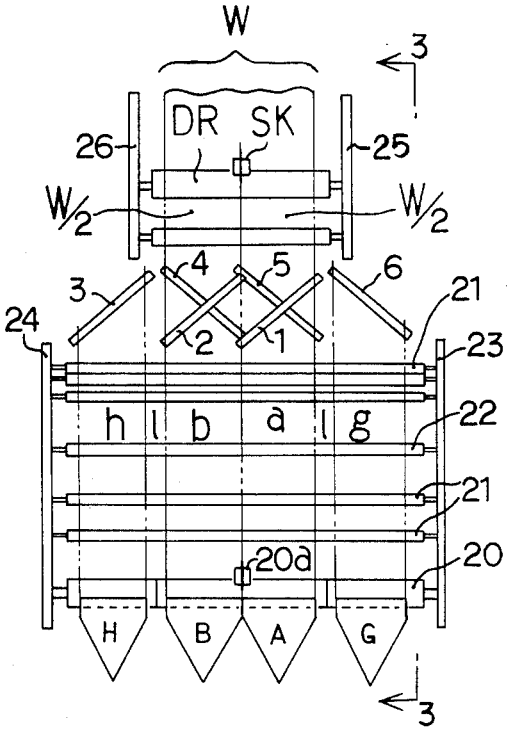
FIG. 2 is a sectional plan view taken along the line 2—2 in FIG. 1.
Figure 3:
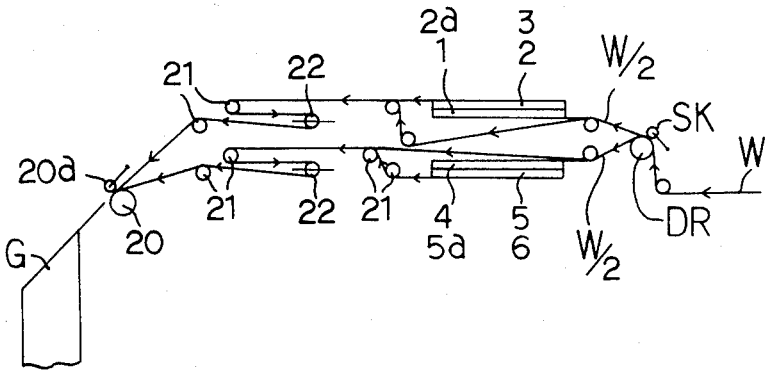
FIG. 3 is a sectional side view taken along the line 3—3 in FIGS. 1 and 2, which shows the embodiment as viewed from the right-hand side thereof.

As shown in FIG. 2, two pairs of crossing turn bars 1, 5 and 2, 4 are respectively disposed above the two inner lanes a and b. In addition, turn bars 3 and 6 exclusively employed for loading are respectively disposed above the two outer lanes g and h. These six turn bars are positioned in such a manner that turn bars which extend parallel with each other, e.g., three turn bars 1, 2 and 3 which extend parallel with each other in one direction, are installed above the other three turn bars 4, 5 and 6 which extend parallel with each other in the other direction.

Among each of the upper and lower turn bar groups, a turn bar exclusively used for unloading which is provided above a lane for the sheet whose course has not yet been changed (the turn bar 1 in the upper turn bar group; the turn bar 4 in the lower turn bar group) is disposed at a position which is lower than the position of a turn bar exclusively used for loading which is provided above a lane for s sheet whose course has already been changed (the turn bar 3 in the upper turn bar group; the turn bar 6 in the lower turn bar group) by a distance corresponding to the diameter of the bar concerned.

Thus, the central turned bar among each of the upper and lower turn bar groups (the turn bar 2 in the upper turn bar group; the turn bar 5 in the lower turn bar group) may be installed at different levels according to the cases. More specifically, in one case, e.g., in the arrangements shown in FIGS. 5 to 7, the central turn bar may be installed at the same level as that of the turn bar 1 or 4 exclusively used for unloading so as to serve as a turn bar 2*a* or 5*a* for unloading which is provided above a lane for the sheet whose course has not yet been changed. In another case, e.g., in the arrangements shown in FIGS. 8 and 9, the central turn bar may be installed at the same level as that of the turn bar 3 or 6 exclusively used for loading so as to serve as a turn bar 2 or 5 for loading which is provided above a lane for a sheet whose course has already been changed. In still another case, e.g., in the arrangements shown in FIGS. 10 and 11, the central turn bar may be removed so as not to obstruct the travel of the sheet which is changing its course.

The way in which the number of sections of a newspaper issued is increased and the way in which the number of pages of each section is varied will be explained below by way of practical examples shown in FIGS. 4 to 11.

In the arrangement shown in FIGS.. 4(A) and 4(B), the full-width sheet W is halved by the slitter knife 20*a*, and the halved sheets are simply introduced into the pair of inner formers A and B (or C and D), respectively. There is therefore no change in the number of sections and in the number of pages.

Figure 5A:
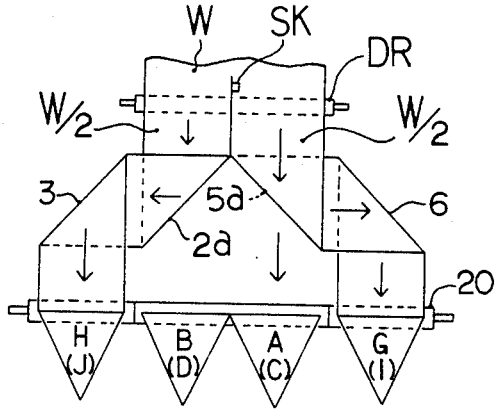
Figure 5B:
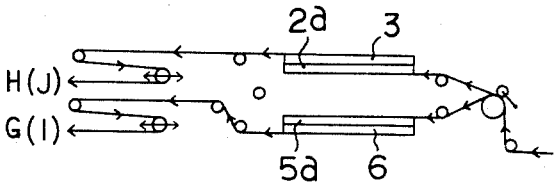
Figure 6A:
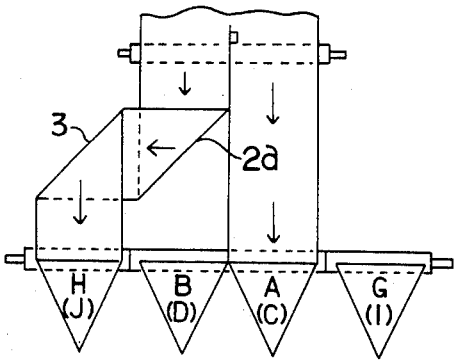
Figure 6B:
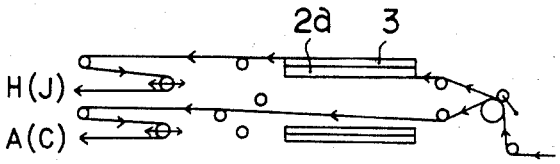
Figure 7A:
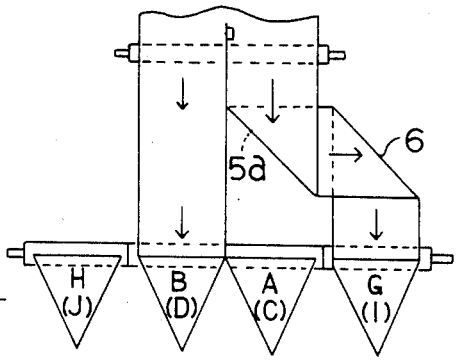
Figure 7B:
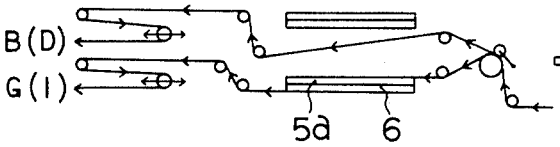
Figure 8A:
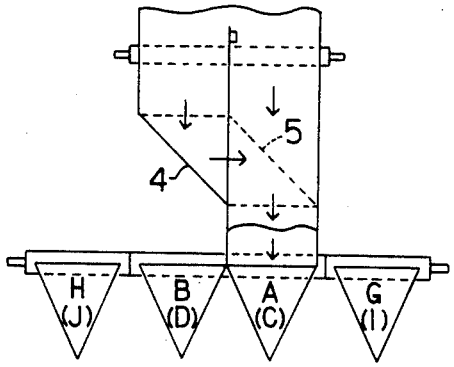
Figure 8B:
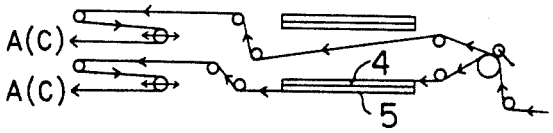
Figure 9A:
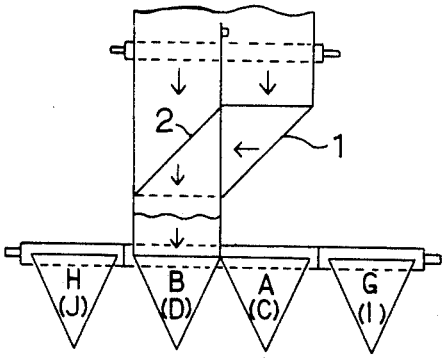
Figure 9B:
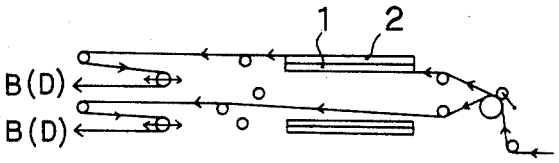
Figure 10A:
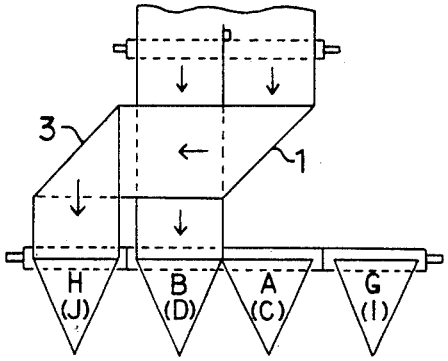
Figure 10B:
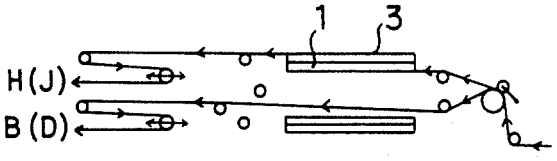
Figure 11A:
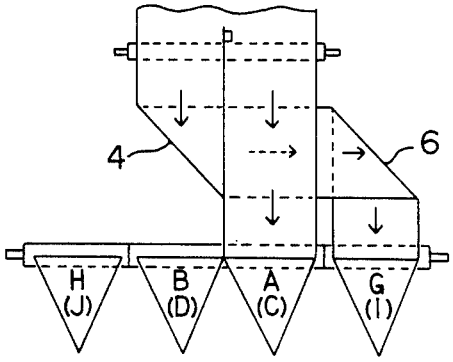
Figure 11B:
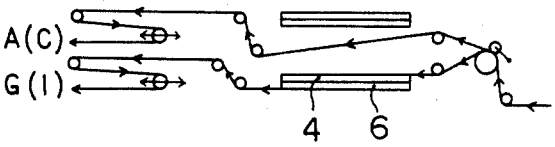

In the arrangement shown in FIGS. 5(A) and 5(B), the full-width sheet W is halved by the slitter knife SK. The left-hand (as viewed in FIG. 5(A)) halved sheet W/2 is passed over the turn bars 2*a* and 3 so that the cource thereof is changed to the outer lane, and the halved sheet W/2 is introduced into the outer former H (J). On the other hand, the right-hand halved sheet W/2 is passed over the turn bars 5*a* and 6 so that the cource thereof is changed to the outer lane, and the halved sheet W/2 is introduced to the outer former G (I).

FIGS. 6(A), 6(B), FIGS. 7(A), 7(B), FIGS. 10(A), 10(B) and FIGS. 11(A), 11(B) respectively show practical examples of changing the course of the sheet traveling on any one of the inner lanes to any one of the outer lanes.

FIGS. 8(A), 8(B) and FIGS. 9(A), 9(B) respectively show practical examples of changing the course of the sheet traveling on either one of the inner lanes to the other so that it is overlaid on the sheet traveling on the second lane.

Figure 15:
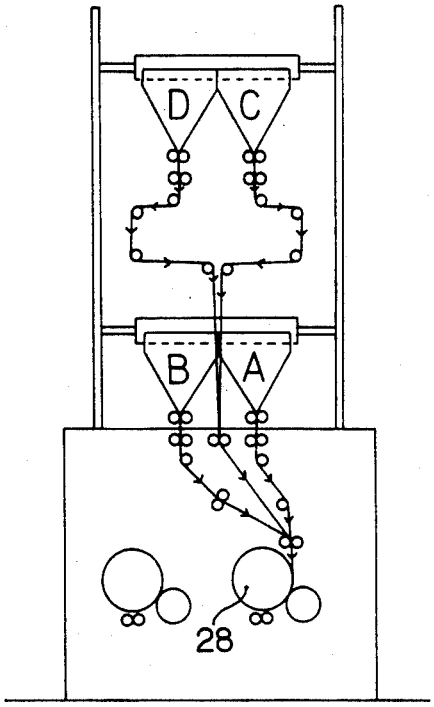
FIG. 15 is a view employed to explain an eight-section collect folding operation by a conventional vertical two-stage former folding machine.

The performance of the conventional vertical two-stage former folding machine (shown in FIG. 15) and that of a folding apparatus (shown in FIG. 14) according to the present invention which is capable of folding eight sections will be explained below by way of comparison.

The conventional folding machine enables issuing of newspaper made up of one to four sections by means of a straight folding operation. However, this conventional machine cannot fold any odd-number sections more than four, that is, five and seven sections. In addition, although even-number sections more than four, that is, six and eight sections can be folded by effecting collecting folding using a folding cylinder 28, such operation disadvantageously halves the production capacity and further limits the number of pages of sections to the same between each pair of corresponding sections.

In contrast to the above, the folding apparatus according to the present invention enables issuing of a newspaper made up of any of one to eight sections, whether the number of sections is odd or even, at high speed by means of a straight folding operation. Further, the number of pages of each section can be varied as desired by virtue of the sheet course changing means which is constituted by the turn bar mechanisms 1, 2, 3, 4, 5 and 6.

In addition, the present invention enables a multi-section folding apparatus to be realized readily and inexpensively by extending and fully utilizing a conventional former folding machine which has already been installed according to need.

Although the present invention has been described through specific terms, it should be noted here that the present invention is not necessarily limited to the above-described embodiments, and various changes and modifications may be imparted thereto without departing from the scope of the invention which is limited solely by the appended claims.

What is claimed is:

1. A multi-section folding apparatus for a rotary press, which comprises:

two inner formers defined by a pair of upper and/or lower formers of a vertical two-stage former folding machine;

two outer formers respectively provided on both sides of said pair of inner formers in such a manner that said outer formers are disposed at the same level as that of said inner formers and with a slight spacing provided therebetween;

a drag roll with a slitter knife for halving longitudinally a traveling sheet fed from a printer toward said inner formers; and two groups of turn bar mechanisms disposed in such a manner that the course of each of the halved sheets traveling on their respective ones of the four travel lanes extending toward said outer and inner formers, respectively, can be changed to any one of the other three lanes.

2. An apparatus according to claim 1, wherein said two outer formers are respectively provided on both sides of the two inner formers defined by said pair of upper formers.

3. An apparatus according to claim 1, wherein said two outer formers are respectively provided on both sides of the two inner formers defined by said pair of lower formers.

4. An apparatus according to claim 1, wherein said two outer formers are respectively provided on both sides of each of the pairs of inner formers defined by said pairs of upper and lower formers.

5. An apparatus according to claim 1, wherein one of said two groups of turn bar mechanisms is composed of three turn bars extending parallel with each other above three lanes, respectively, other than one outer lane, while the other group is composed of three turn bars extending parallel with each other above three lanes, respectively, other than the other outer lane, and said two turn bar groups are disposed at different levels and extend in respective directions which intersect at 90°.

6. An apparatus according to claim 5, wherein, among the three turn bars constituting each of said two groups, one turn bar which is provided above a lane for the traveling sheet whose course has not yet been changed is positioned at a level different from that of another turn bar which is provided above a lane for the sheet whose course has already been changed, the level difference corresponding to the diameter of the bar concerned.

7. An apparatus according to claim 5, wherein the central turn bar among the three turn bars constituting each of said two groups is disposed at a level which depends upon whether said central turn bar is employed for turning the traveling sheet whose course has not yet been changed or has already been changed, since said central turn bar may be employed in both cases in accordance with the form of changing the course of the traveling sheet.

8. An apparatus according to claim 1, wherein the central turn bar among the three turn bars constituting each of said two groups is installed so as to be easily detachable in accordance with the form of changing the course of the traveling sheet.

* * * * *